United States Patent [19]

Mulder et al.

[11] Patent Number: 4,481,728

[45] Date of Patent: Nov. 13, 1984

[54] DIPPER TOOTH TIP AND ADAPTER

[75] Inventors: James P. Mulder, Oakland; Michael C. Meslink, Franklin Lakes, both of N.J.

[73] Assignee: Abex Corporation, Stamford, Conn.

[21] Appl. No.: 411,168

[22] Filed: Aug. 25, 1982

Related U.S. Application Data

[63] Continuation-in-part of Ser. No. 326,214, Dec. 1, 1981, abandoned.

[51] Int. Cl.[3] ..... E02F 9/28

[52] U.S. Cl. ..... 37/142 A; 403/379

[58] Field of Search ..... 37/141 T, 142 R, 142 A; 403/378, 379, 325

[56] References Cited

U.S. PATENT DOCUMENTS

| | | | |
|---|---|---|---|
| 2,915,290 | 12/1959 | Petersen | 37/142 R X |
| 3,091,044 | 5/1963 | Penote et al. | 37/142 R |
| 3,117,386 | 1/1964 | Ferwerda | 37/142 R |
| 3,196,956 | 7/1965 | Ratkowski | 37/142 A X |
| 3,520,224 | 7/1970 | Hensley et al. | 37/142 A X |
| 3,650,053 | 3/1972 | Baer | 37/142 A |
| 3,655,244 | 4/1972 | Swisher | 37/142 R X |
| 3,685,178 | 8/1972 | Ratkowski | 37/142 A |
| 4,192,089 | 3/1980 | Schwappach | 37/142 A |
| 4,335,532 | 6/1982 | Hahn et al. | 37/142 R |

*Primary Examiner*—Edgar S. Burr
*Assistant Examiner*—Moshe I. Cohen
*Attorney, Agent, or Firm*—Thomas S. Baker, Jr.

[57] ABSTRACT

An adapter tip assembly wherein the nose of the adapter which is received in a tip socket has a circular rear base joined to an ellipsoidal portion which tapers to an elliptical front end such that the external front surface of the tip has a wider horizontal dimension than vertical dimension and the tip is retained on the nose by a retaining pin; the front end ellipse is diminished by upper and lower rearwardly extending flat surfaces and these surfaces merge into upwardly and rearwardly angled surfaces which in turn merge into the ellipsoidal portion.

1 Claim, 18 Drawing Figures

DIPPER TOOTH TIP AND ADAPTER

This is a continuation-in-part of application Ser. No. 326,214, filed Dec. 1, 1981, now abandoned.

BACKGROUND OF THE INVENTION

This invention relates to an adapter and tooth tip assembly which is adapted to be mounted on a lip of a dipper bucket. The tip is retained on the adapter by the adapter-tip interface and by a drive through pin.

A plurality of adapter-tip assemblies are mounted on the lip of a dipper bucket to scrape and dig material which goes into the bucket. Each adapter is rigidly affixed to the lip by one of several well-known means, including a C-clamp and wedge arrangement. The nose of an adapter projects beyond the lip and is received in the socket of a removable tooth tip.

During operation of a dipper bucket, the outermost or front end of a tip is abraded while digging and scraping material. In addition, the tip is subjected to bending stresses. In order to prevent failure or breakage of the tip, the wall at the rear of the tip between the outside surface of the tip and the adapter receiving socket must be of sufficient thickness to resist the stresses. A problem with a tip which has a high maximum stress for a given load is that this wall thickness must be increased. Since the allowable weight of a tip is limited in order to enable handling by one man, it is advantageous to have as low a maximum stress as possible to permit a thinner wall section at the rear and a heavier spade section at the front to prolong the useful life of the tip. This increases the tonnage of material dug before a tip is replaced and reduces the weight of the material remaining in a tip when it is replaced.

The front of a tip used on a dipper bucket has a flat, spade-like shape for optimum digging efficiency. In other words, when a dipper bucket having a plurality of adapter-tip assemblies is positioned such that the assemblies are parallel with the ground, the tips have a greater horizontal dimension than vertical dimension.

During operation of a dipper bucket a tip, particularly one mounted at the end of the lip, is subjected to loads from all directions. In an adapter-tip assembly the adapter functions to transfer the stress exerted on the tip to the dipper bucket. Consequently, an adapter must be able to resist stresses exerted on the tip from all directions.

In a previous tip and adapter assembly manufactured by the assignee of the instant invention, the nose of the adapter which was received in a complementary shaped socket formed in a tooth tip had a rectangular cross-section at its base which tapered to a small rectangular front edge. The rectagular front edge permitted the external shape at the front of the tip to have a spade-like shape. It was found that with this design the tip had a relatively high maximum stress with respect to a given load. Consequently, a relatively high percentage of metal was required in the rear of the tip compared to what could be put in the front of the tip.

Also, it was found that, during the casting of the tip, the sharp corners and fillets in the rectangular areas experienced thermal shock which resulted in quench cracks and other defects. Additionally, a proper fit between the tip and adapter was frequently hard to achieve from the parts as cast and machining of the adapter nose and tip socket was frequently required. In addition to the obvious expense resulting from machining the adapter and tip, the machining sometimes caused another problem in that the holes cast in the tip and adapter which receive a retaining pin were sometimes misaligned after machining. Further, the rectangular cross-section of the adapter tip interface caused higher maximum stresses in the corners than in the walls. Since the corners of the tip socket had to be thick enough to resist the maximum stress, the wall thickness was greater than necessary.

In some adapter-tip assemblies it is necessary for a workman to remove a pin which retains a tip on an adapter from the bottom of the assembly. This is difficult and inconvenient, especially when a tip must be replaced frequently. Another disadvantage of some pins is that they are a two- or three-piece assembly and the pieces are separable. This enables a workman to mix worn and unworn pieces to form an assembly, which is undesirable because the worn piece will cause the new pieces to wear faster than normal and/or the assembly will not properly retain the tip on the adapter. A further disadvantage of some multi-piece pin assemblies which include a resilient member which deforms when the pin is inserted or removed is that dust which collects around the pin assembly can prevent deformation of the resilient member and make pin removal difficult.

It is desirable to provide an adapter-tip assembly in which the adapter nose and the tip socket are shaped such that the maximum stress of the tip is equal in all directions and the percentage of metal which is provided in the spade section of the tip is maximized.

It is also desirable to provide an adapter-tip assembly in which sharp corners in the tip and adapter are eliminated so that the castings are easier to manufacture.

In addition, it is desirable to provide an adapter-tip assembly in which the tip can be mounted on the adapter as cast without further machining and the bores in the tip and adapter are properly aligned to receive a retaining pin.

Further, it is desirable to provide an adapter and tip having a pin assembly for retaining the tip on the adapter, which can be removed by a workman having access solely to the top of the assembly, which is unitary in that the pieces of the assembly are bonded together and which ensures that the resilient member can deform to permit easy removal of the pin assembly when dust is packed around the assembly.

SUMMARY OF THE INVENTION

The instant invention provides an adapter-tip assembly wherein the nose of the adapter which is received in a tip socket has a circular base which tapers to an elliptical front end, such that the external front surface of the tip has a wider horizontal dimension than vertical dimension, the adapter is able to resist and carry loads from the tip to the bucket equally from and in all directions and the adapter and tip can be assembled with a good fit between the nose and tip sockets as cast. The tip is retained on the nose by a retaining pin, which can be inserted and removed solely by access to the top of the adapter-tip assembly.

DESCRIPTION OF THE INVENTION

Figure 1:
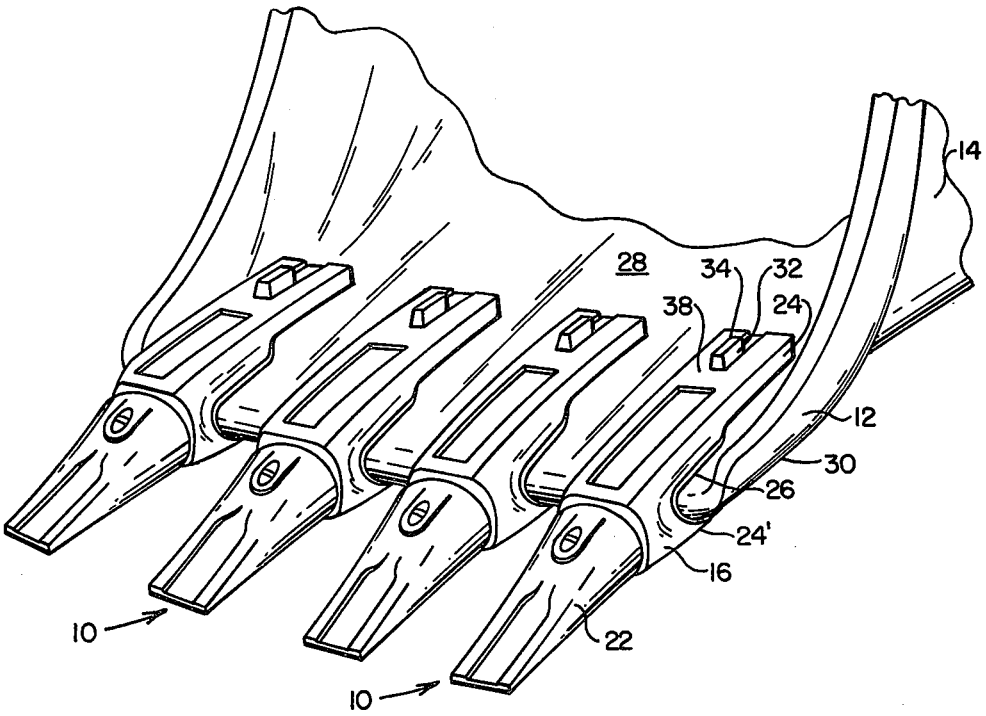
FIG. 1 is a perspective view of the lip of a dipper bucket on which a plurality of adapter-tip assemblies are mounted.
Figure 2:
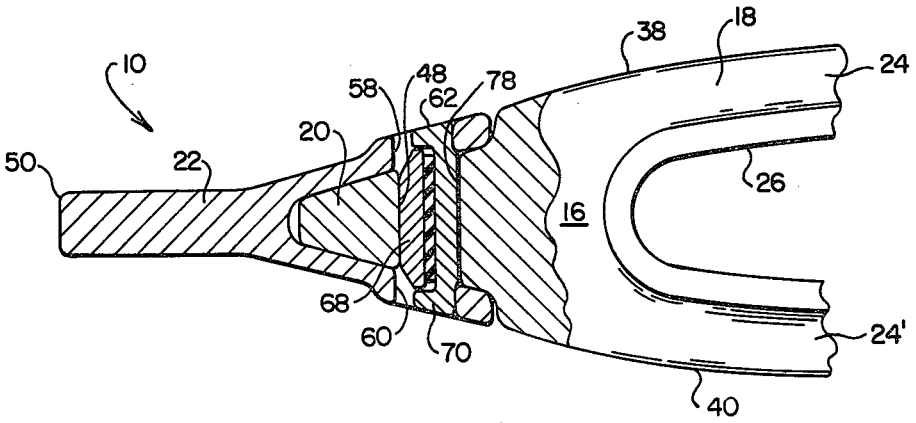
FIG. 2 is a longitudinal sectional view of an adapter-tip assembly.

Referring to FIGS. 1 and 2, a plurality of adapter-tip assemblies 10 are shown mounted on the lip 12 of a dipper bucket 14. The adapter 16 in each assembly 10 includes an elongated U-shaped rear portion 18 which engages the lip 12 and a relatively short front portion or nose 20 which receives a tip 22, as described hereinafter. U-shaped portion 18 includes a pair of legs 24, 24′ with a slot 26 therebetween. When the adapter 16 is mounted on the dipper 14, the lip 12 is received in the slot 26, one leg 24 overlies a top surface 28 of lip 12 and the other leg 24′ overlies a bottom lip surface 30. Adapter 16 is retained on lip 12 by a C-clamp 32 which passes through holes, not shown, in leg 24, lip 12 and leg 24′. The ends 34 of C-clamp 32 overlie the outer surfaces 38, 40 of the legs 24, 24′, respectively. C-clamp 32 is held in position by a wedge, not shown, which is driven against clamp 32 in the aforementioned holes in legs 24, 24′ and lip 12.

Figure 3:
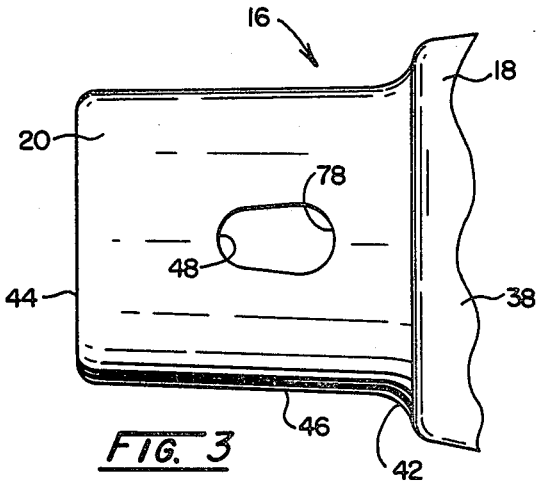
FIG. 3 is a plan view of an adapter nose.
Figure 4:
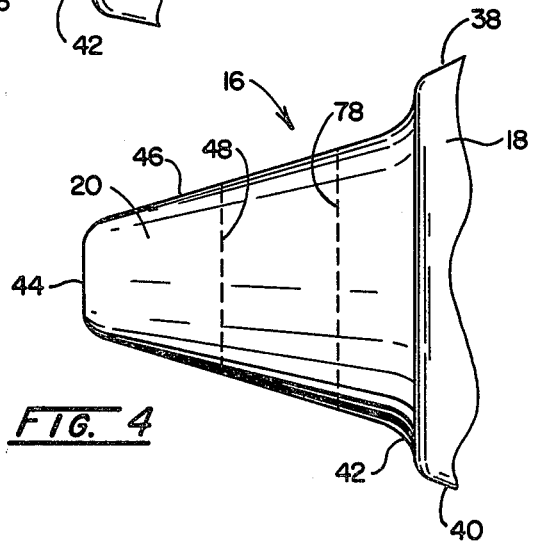
FIG. 4 is a side view of an adapter nose.
Figure 5:
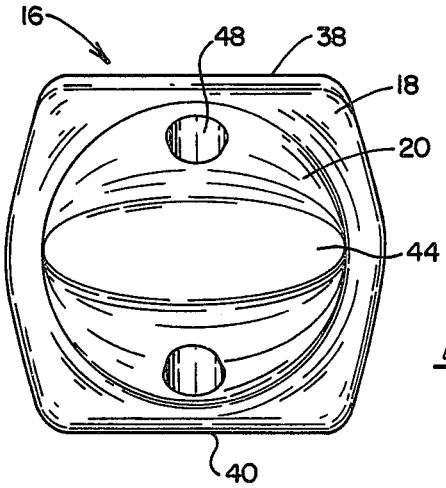
FIG. 5 is a front view of an adapter.
Figure 3A:
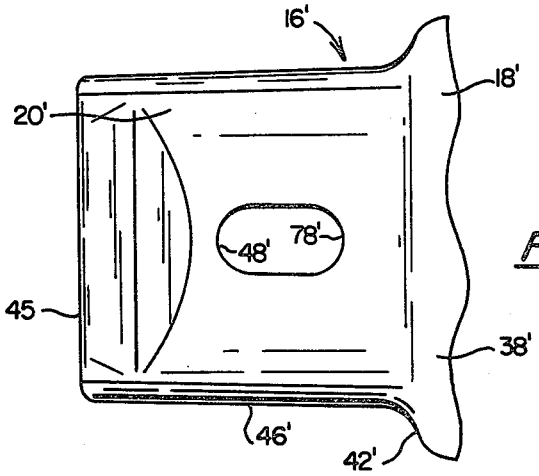
FIG. 3A is a plan view of a second embodiment of an adapter nose.
Figure 4A:
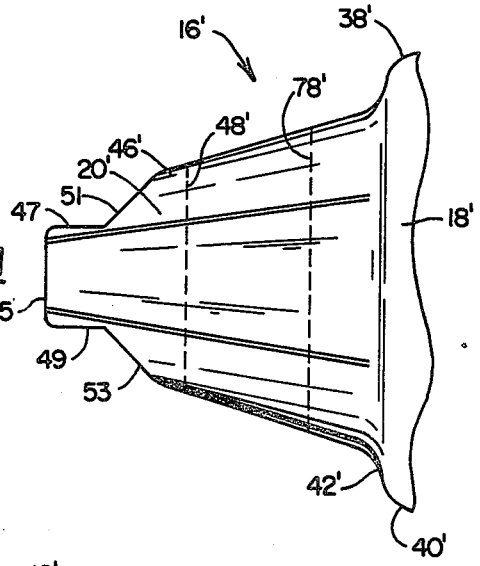
FIG. 4A is a side view of the adapter nose of FIG. 3A.
Figure 5A:
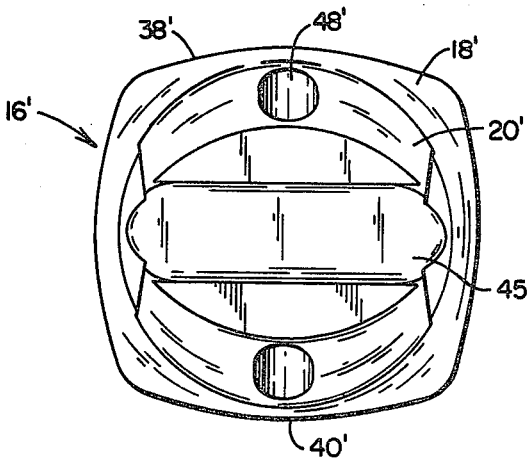
FIG. 5A is a front view of the adapter of FIG. 3A.
Figure 6:
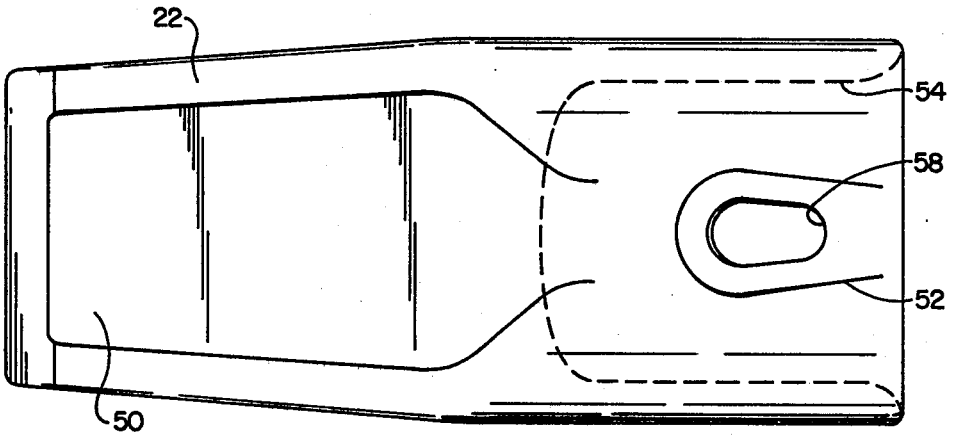
FIG. 6 is a plan view of a tip.

Referring to FIGS. 3–5, it can be seen that the base 42 of adapter nose 20 is circular where the nose 20 joins the rear portion 18 of the adapter 16. Adapter nose 20 tapers from the base 42 to a front end 44 which is in the shape of a horizontal ellipse. The outer surface 46 of nose 20 between the base 42 and the front end 44 has a linear ellipsoidal shape. This shape is generated by taking points at different angular positions on the outer surface of base 42 and connecting them with straight lines to points on an ellipse that has been projected from equally spaced points on a circle whose diameter is equal to the major axis of the ellipse.

A generally oval pin-receiving hole 48 is formed in nose 20 approximately midway between base 42 and front end 44. The hole 48 extends in a vertical direction when adapter 16 is viewed from the side or front, as shown in FIGS. 4 and 5.

A second embodiment of an adapter is shown in FIGS. 3A–5A. This adapter 16′ is a modification of the adapter 16 described in FIGS. 3–5 and identical portions are indicated by identical primed numbers. Nose 20′ of adapter 16′ tapers from a circular base 42′ to a front end 45 which is in the shape of a modified horizontal ellipse. This ellipse is formed by taking the elliptical adapter nose 20 of FIG. 4 and diminishing it by forming a pair of spaced parallel surfaces 47, 49 which extend rearwardly from front end 45 and terminate in a pair of surfaces 51, 53, respectively, which angle upwardly and rearwardly and merge into linear ellipsoidal outer surface 46′. The horizontal surfaces 47, 49 formed on nose 20′ reduce the angle at which the adapter 16′ and a tip socket meet and thereby provide additional resistance to a force tending to twist a tip off the adapter 16′. This force must be resisted by a retainer pin. Therefore, the adapter 16′ reduces the stress on a retainer pin. A pin-receiving hole 48′ is formed in nose 20′ approximately midway between base 42′ and front end 45.

Figure 7:
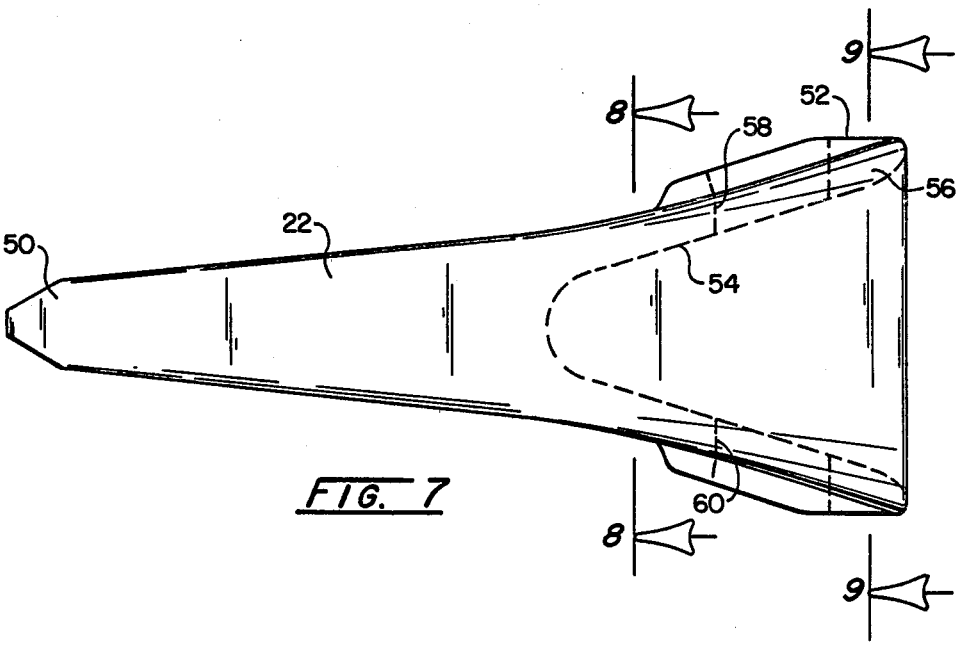
FIG. 7 is a side view of a tip.
Figure 8A:
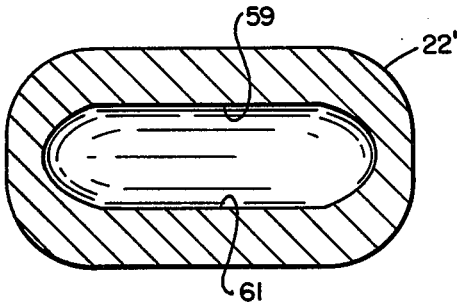
FIG. 8A is a lateral section along line 8A—8A of FIG. 7A.
Figure 8:
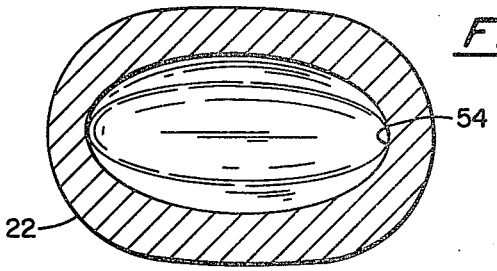
FIG. 8 is a lateral section along the line 8—8 of FIG. 7.
Figure 9:
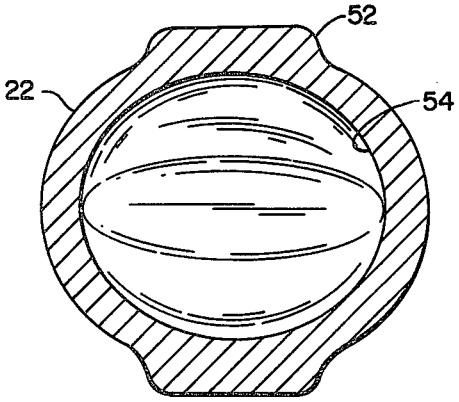
FIG. 9 is a lateral section along the line 9—9 of FIG. 7.

Tip 22 of assembly 10 can best be seen by referring to FIGS. 2 and 6–9. The front end 50 of tip 22 has a generally flat, spade-like outer surface which has a greater horizontal dimension than vertical dimension. It is the front end 50 of tip 22 which is severely abraded when the tip 22 is digging and scraping material loaded into dipper bucket 14. The cross-sectional area of tip 22 gradually increases from the front end 50 to the back end 52 which is adjacent the base 42 of adapter nose 20 when the tip 22 is mounted on the adapter 16 such that the outer surface of end 52 merges into the outer surface of adapter 16. A socket 54 is formed in back end 52. Socket 54 is contoured to complement the outer surface 46 of adapter nose 20. Consequently, the entrance to socket 54 is circular, as shown in FIG. 9, and the bottom of socket 54 is in the shape of a horizontal ellipse, as shown in FIG. 8. An outer wall 56 surrounds socket 54. The thickness of wall 56 is sufficient to resist bending stresses exerted on tip 22.

A pair of generally oval pin-receiving holes 58, 60 are formed in wall 56. The holes extend vertically when tip 22 is viewed from the side, as shown in FIG. 7. When tip 22 is mounted on adapter 16 such that nose 20 is received in socket 54, the tip holes 58, 60 are aligned with adapter hole 48. Hole 48 is slightly larger than holes 58, 60 to accommodate a locking feature of a retaining pin, as will be explained below.

Figure 7A:
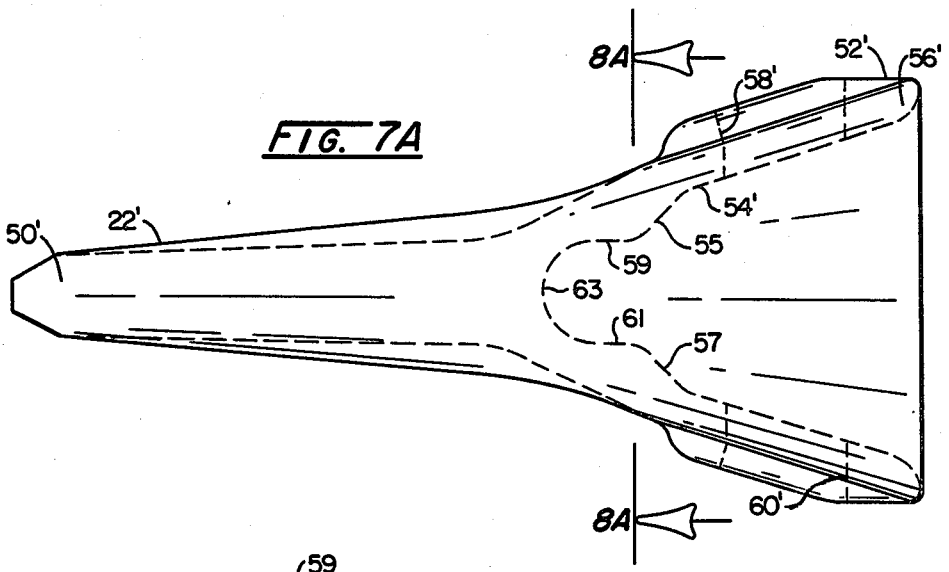
FIG. 7A is a side view of a second embodiment of a tip which receives the adapter shown in FIGS. 3A–5A.

A second embodiment of a tip is shown in FIGS. 7A and 8A. This tip 22′ is a modification of the tip 22 shown in FIGS. 6–9 and identical portions are indicated by identical primed numbers. The adapter receiving socket 54′ is modified to complement and receive the nose 20′ of the modified adapter 16′ described above. Therefore, the entrance to socket 54′ is circular and the bottom of the socket 54′ is in the shape of a modified ellipse, as shown in FIG. 8A. The bottom of socket 54′ is defined by a pair of inwardly slanted surfaces 55, 57 which intersect a pair of horizontal surfaces 59, 61, respectively. The ends of the horizontal surfaces 59, 61 are connected by a curved surface 63. Surface 63 does not exactly complement the end 45 of adapter nose 20′ since surface 63 is curved for ease of casting, whereas end 45 is flat. However, since the two surfaces 63, 45 do not engage each other the fact that they are not complementary is unimportant. A pair of pin-receiving holes 58′ and 60′ are formed in tip 22′.

Figure 11A:
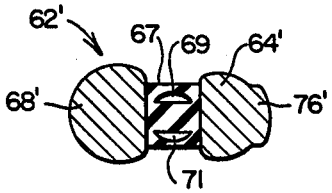
FIG. 11A is a cross-sectional view along the line 11A—11A of FIG. 10A.
Figure 10A:
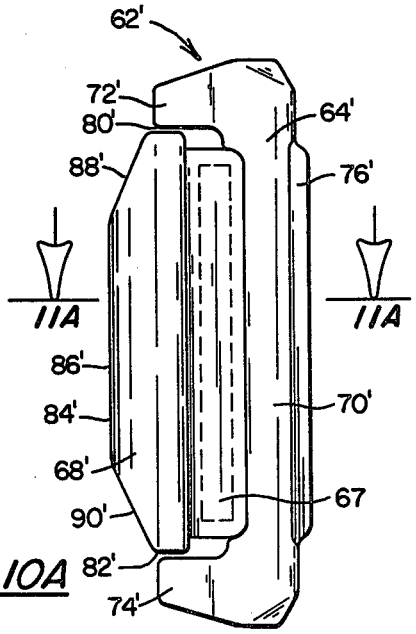
FIG. 10A is a side view of a second embodiment of a retainer pin.
Figure 10:
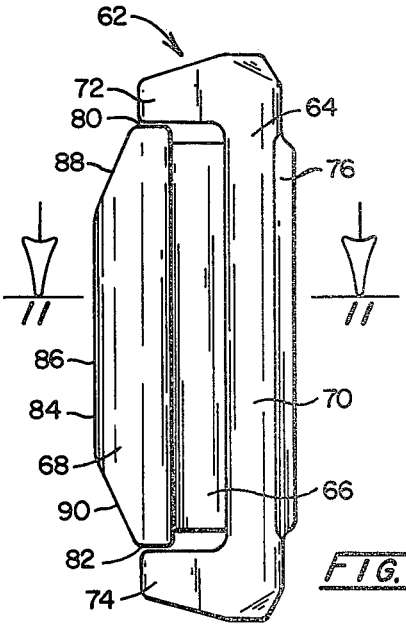
FIG. 10 is a side view of a pin.
Figure 11:
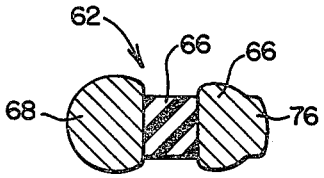
FIG. 11 is a cross-sectional view along the line 11—11 of FIG. 10.

Tip 22 is retained on adapter 16 by a unitary pin assembly 62 shown in FIGS. 2, 10 and 11. Pin assembly 62 comprises three members: a U-shaped longitudinal lock member 64, a wedge member 68 and a central resilient member 66 which is between and bonded to the lock member 64 and the wedge member 68. Lock member 64 includes a longitudinally central body 70 and a pair of legs 72, 74 which project perpendicularly from each end of body 70 in the same direction. A longitudinally extending lock tab 76 projects from body 70 in a direction opposite to that from which the legs 72, 74 project. The length of lock tab 76 is approximately equal to the length of the back wall 78 of adapter hole 48. The length of wedge member 68 is slightly less than the distance between lock member legs 72, 74. In fact, the legs 72, 74 overlie the ends 80, 82, respectively, of wedge member 68. Wedge member 68 includes a front surface 84 opposite resilient member 66 which has a central section 86 parallel to lock tab 76 and a pair of end sections 88, 90 which taper inwardly from central section 86 to ends 80, 82, respectively.

As previously mentioned, pin assembly 62 functions to retain tip 22 on adapter nose 20. After tip 22 is mounted on nose 20, such that the holes 58, 60 in socket wall 56 are aligned with adapter hole 48, one leg 72, 74 of lock member 64 is set in hole 58 with wedge member 68 facing the front end 50 of tip 22 and member 64 is driven downwardly through hole 58 and into hole 48 by an operator pounding a hammer against the other leg 72, 74. Since pin assembly 62 is symmetrical, it does not matter which leg 72, 74 is first inserted into hole 58. As lock member 64 is driven downwardly, wedge member 68 is also driven downwardly, since it is captured within member 64. As it is driven downwardly wedge member 68 is forced inwardly of lock member 64 by the engagement of tapered surfaces 88, 90 with the wall of hole 58 compressing resilient member 66. Lock tab 76 is also biased against the wall of hole 58. Pin assembly 62 is driven downwardly into hole 48 until lock tab 76 passes the wall of hole 58 and is within nose hole 48.

Since pin assembly 62 is symmetrical and wedge member 68 is tapered at each end, assembly 62 can be driven out of adapter-tip assembly 10 through either tip hole 58, 60. To remove assembly 62 an operator drives a piece of metal rod against one leg 72, 74 of member 64. As the rod is driven into one of the tip holes 58, 60, one end of lock tab 76 is driven against the wall defining the opposite hole 58, 60, resilient member 66 is compressed and assembly 62 is removed from the opposite hole 58, 60. Pin assembly 62 is a drive-through type retaining pin, since it can be driven into one tip hole 58, 60 and out the other hole 58, 60.

A second embodiment of a retainer pin is shown in FIGS. 10A and 11A. The pin assembly 62' is a modification of pin 62 shown in FIGS. 10 and 11 and identical portions are indicated by identical primed numbers. Pin 62' comprises a U-shaped longitudinal lock member 64', a wedge member 68' and a central resilient member 67 which is between and bonded to the lock member 64' and the wedge member 68'. Resilient member 67 is recessed within lock member 64' and can also be recessed within wedge member 68' although it is not shown as such in FIG. 10A. Pin assembly 62' differs from previously described pin assembly 62 by having a pair of hollow, longitudinally extending cavities 69, 71 formed in resilient member 67. Cavities 69, 71 are sealed at each end. During operation of the dipper dust packs around a pin assembly 62' and removal is difficult because there is no space for resiient member 67 to be displaced in one direction as it is compressed in the other direction. The cavities 69, 71 provide a space for resilient member 67 to compress into during removal of the pin assembly 62'. Although two cavities 69, 71 are shown in the instant embodiment, one or more cavities would perform the same function. Consequently, the number of cavities is immaterial.

Although preferred embodiments of the invention have been illustrated and described, it will be apparent to those skilled in the art that various modifications may be made without departing from the spirit and scope of the present invention.

What is claimed is:

1. An adapter tip assembly for a dipper bucket which comprises an addapter having means for receiving the lip of a bucket at one end and means for receiving a replaceable tooth tip at the other end, the tooth tip being retained on the adapter by means of a vertically oriented pin which resists forces tending to twist the tooth tip off the adapter, said adapter being shaped to minimize the stress of said forces on said pin and distributing stresses on the adapter equally in all directions, the shape of said adapter being defined by:

a nose having a circular base at the rear portion, an outer surface forwardly of said circular base of substantially linear ellipsoidal shape and tapering toward a front portion having the shape of a horizontal ellipse, said horizontal ellipse having elliptical side surfaces joined by a pair of parallel upper and lower horizontal surfaces which merge into the elliptical side portions of the front portion of the tooth tip which horizontal surfaces project rearwardly from the front portion and merge into angled surfaces which extend rearwardly and outwardly and merge into said surface of linear ellipsoidal shape, said angled surfaces each being bounded by a curved line where they join said surface of linear ellipsoidal shape, and a straight line joining the ends of said curved line, said straight line being the juncture between the rear edge of said horizontal surfaces and the forward edge of said angled surfaces, and a vertically oriented pin-receiving hole formed in said outer surface;

and a tooth tip having a front surface and a back end, a socket formed in the back end which substantially complements the adapter nose and includes a pair of parallel horizontal surfaces which extend the width of the nose front portion such that the tooth tip fits securely on the adapter and engages substantially the entire outer surface of the adapter nose, and a pair of pin receiving openings formed in the back end of the tooth tip which openings are aligned with said hole when the nose is received in the socket; said outer surface of ellipsoidal shape and the horizontal ellipse at the front of the adapter serving to distribute stresses on the tip toward equality in all directions while said horizontal surfaces reduce stress on the pin when the assembly is used to dig.

* * * * *